United States Patent [19]

Horvay

[11] 4,114,065

[45] Sep. 12, 1978

[54] REFRIGERATOR CABINET AND METHOD OF CONSTRUCTING

[75] Inventor: Julius B. Horvay, Louisville, Ky.

[73] Assignee: General Electric Company, Louisville, Ky.

[21] Appl. No.: 749,164

[22] Filed: Dec. 9, 1976

[51] Int. Cl.[2] ..... B65D 25/18; F25D 11/00

[52] U.S. Cl. ..... 312/214; 312/236; 220/419; 62/298; 220/444

[58] Field of Search ..... 312/214, 312, 236; 220/9 G; 62/440, 298

[56] References Cited

U.S. PATENT DOCUMENTS

| | | | |
|---|---|---|---|
| 2,068,532 | 1/1937 | Boddy | 220/9 G |
| 2,111,411 | 3/1938 | Spreen | 312/236 |
| 2,180,886 | 11/1939 | Thomas | 220/9 G |
| 2,205,779 | 6/1940 | Forsthoefel | 220/9 G |
| 2,478,145 | 8/1949 | Weber | 312/236 |
| 2,751,106 | 6/1956 | Schrader | 220/9 G |
| 3,380,615 | 4/1968 | Kessler | 312/214 |
| 3,933,398 | 1/1976 | Haag | 312/214 |
| 3,948,410 | 4/1976 | Anderson | 312/214 |

*Primary Examiner*—Mervin Stein

*Assistant Examiner*—Victor N. Sakran

*Attorney, Agent, or Firm*—Francis H. Boos

[57] ABSTRACT

A single sheet of metal is stamped to provide portions which form the top, side and bottom outer walls of the refrigerator cabinet and portions which form the top, side and bottom inner walls of the cabinet. This single sheet of metal is stamped in the same operation to include a plurality of perforations in an elongated section thereof extending lengthwise of the sheet between the portions which form the outer wall and the portions which form the inner wall. This same elongated section is further shaped to provide a groove of arcuate cross-section extending substantially the length thereof. The single sheet of metal is then bent to form in one operation the top, side and bottom outer walls of the refrigerator and the top, side and bottom inner walls of the refrigerator, the elongated perforated section framing the door opening of the refrigerator, the perforations retarding heat transfer from the outer walls. A portion of the tubing forming the condenser of the refrigerating system employed with the refrigerator is assembled in the aforementioned arcuate groove. mentioned arcuate groove.

10 Claims, 12 Drawing Figures

FIG. 1
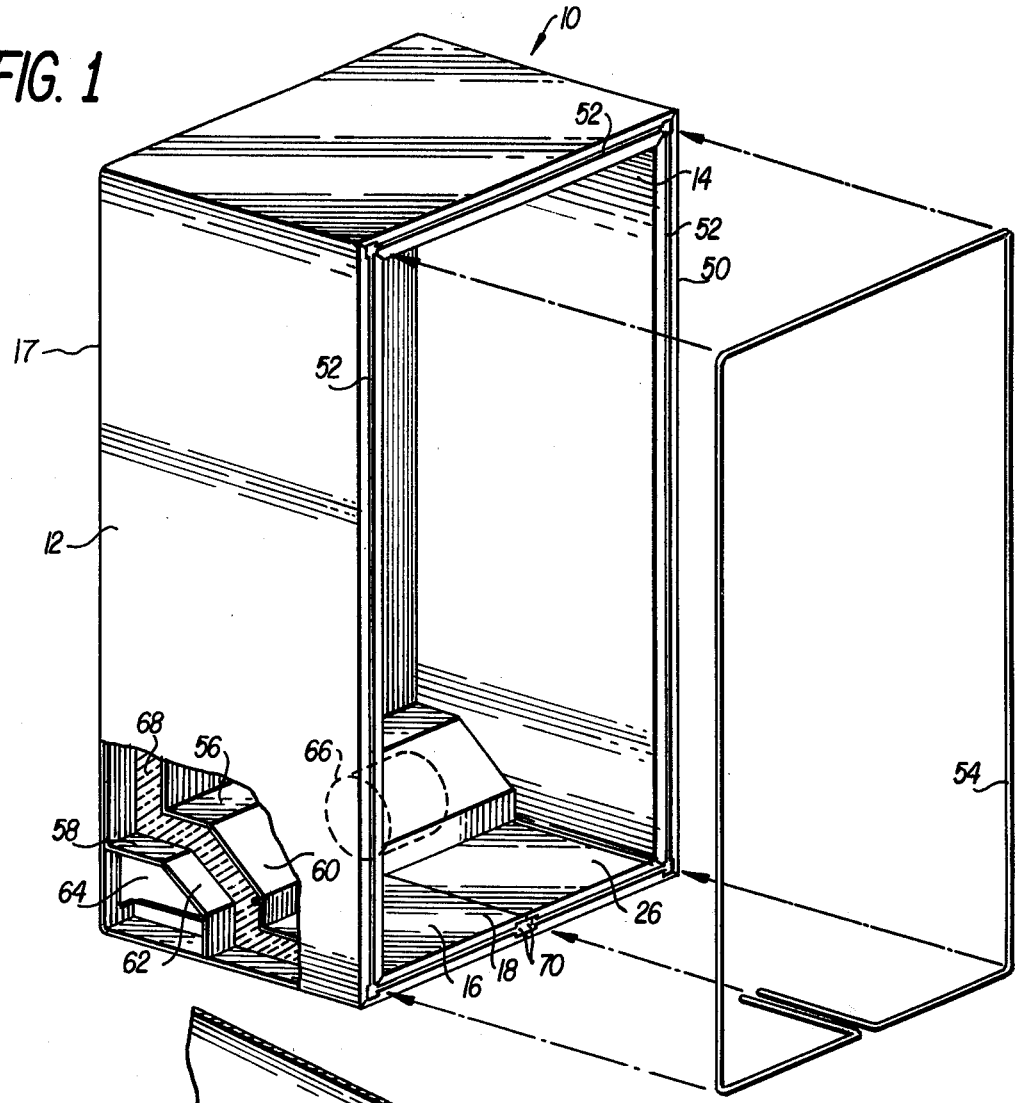
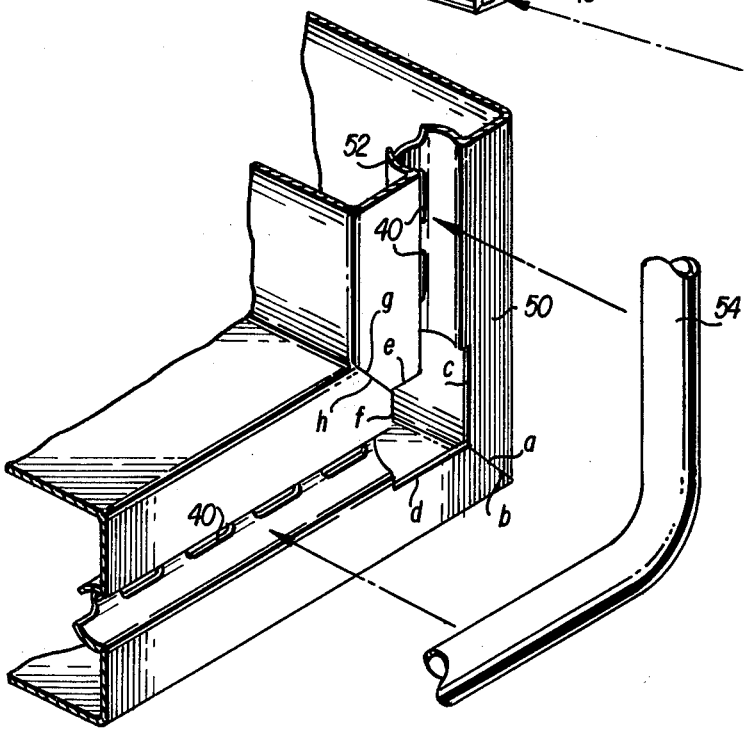
FIG. 5

REFRIGERATOR CABINET AND METHOD OF CONSTRUCTING

BACKGROUND OF THE INVENTION

1. Field of the Invention

This invention relates to cabinets and more particularly to cabinets, such as refrigerators, which are required to maintain the interior of the cabinet at a temperature differing substantially from ambient, and to methods of making such cabinets.

2. Description of the Art

Many cabinet constructions, for example, those employed for household appliances and particularly for refrigerators, include an outer wall and an inner wall spaced from the outer wall, with suitable insulation being included between the outer and inner walls. Usually, the outer wall and the inner wall are made of separate components and assembled in some manner. It has been recognized that for economy of manufacture it would be desirable to fashion a refrigerator cabinet, or the major portion thereof, from a single sheet of metal which could be formed to provide both the outer wall and the inner wall. This has been particularly difficult in the case of refrigerators because the interior of the refrigerator cabinet must be maintained at a temperature differing substantially from that exterior of the cabinet. It is, therefore, necessary that some provision be made for retarding heat transfer from the outer wall to the inner wall both from the standpoint of efficiency of the refrigerator and from the standpoint of eliminating condensation of moisture on the outer wall in the region closest to the inner wall.

Various approaches have been taken in the manufacture of refrigerator cabinets with the objective of reducing cost and insuring against "sweating" of the exterior of the cabinet. In one approach, the outer wall and the inner wall or liner were formed of separate metal components and the two then supported in assembled relationship by breaker strips framing the door opening and connected to the inner and outer walls. The breaker strips were made of material having low thermal conductivity, thereby retarding heat transfer from the outer wall and eliminating sweating.

In another approach, which employed a separate metal outer wall and a separate metal inner wall or liner, the breaker strip was eliminated, and the metal liner was connected directly to the metal outer wall. Perforations were provided in a flange along the edge of the liner to retard heat transfer. To improve the appearance, these perforations were then filled with vitreous enamel. This construction still, of course, required forming the inner and the outer wall in separate pieces and assembling these components by screws or other fasteners, a procedure which requires time for assembly and increases cost. Moreover, it required a specific operation to fill the perforations fully with vitreous enamel in order to insure a pleasing appearance.

Another approach has been to make the outer wall of metal and the inner wall or liner of a one-piece plastic material. This approach also requires that the outer wall and the inner wall be formed as separate parts and the two be thereafter assembled to one another.

None of these prior art constructions achieved the objective of a construction by which both the outer wall and the inner wall of the refrigerator cabinet could be formed from essentially one piece of metal, with adequate provision for retarding heat transfer and for obtaining a pleasing appearance. By this invention, the outer walls and the inner walls of a refrigerator cabinet are formed, in accordance with the method of this invention, from a single sheet of metal which, prior to being bent into assembled form, is stamped to a shape which includes appropriate notches for facilitating bending to the appropriate form and also perforations and for retarding heat transfer. Further, when assembled, the cabinet provides a pleasing appearance without the necessity of filling the perforations with any concealing material such as vitreous enamel.

Accordingly, it is an object of this invention to provide an improved refrigerator cabinet construction which facilitates manufacture and reduces cost.

It is another object of this invention to provide an improved arrangement, economical in construction, for retarding heat transfer between the outer walls and the inner liner of the refrigerator, such arrangement including provision for simply and effectively concealing perforations used to retard heat transfer.

It is a further object of this invention to provide a refrigerator cabinet construction wherein the cabinet is formed from a single sheet of metal which is stamped while in sheet form to provide the necessary shape of all parts thereof and then bent in a single operation to form the refrigerator cabinet.

It is still a further object of this invention to provide in a simple and economic manner supplementary heat at a critical region to eliminate sweating of the outer wall and door gasket, and at the same time keep the added heat load on the refrigerator system to a minimum.

It is a further object of this invention to provide an improved method for constructing a refrigerator cabinet.

SUMMARY OF THE INVENTION

In carrying out this invention, both as to the cabinet structure and method of constructing, in one form thereof, a single sheet of metal is stamped to provide portions which form the top, side and bottom outer walls of the refrigerator cabinet and portions which form the top, side and bottom inner walls of the cabinet. This single sheet of metal is stamped in the same operation to include a plurality of perforations in an elongated section thereof extending lengthwise of the sheet between the portions which form the outer wall and the portions which form the inner wall. This same elongated section is further shaped to provide a groove of arcuate cross-section extending substantially the length thereof. The single sheet of metal is then bent to form in one operation the top, side and bottom outer walls of the refrigerator and the top, side and bottom inner walls of the refrigerator, the elongated perforated section framing the door opening of the refrigerator, the perforations retarding heat transfer from the outer walls. A portion of the tubing forming the condenser of the refrigerating system employed with the refrigerator is assembled in the aforementioned arcuate groove. This condenser tubing both conceals the perforations in the assembled cabinet and provides a readily available economical source of supplementary heat in the area between the inner and outer walls to raise the temperature of the outer wall and hence to further assist in eliminating sweating thereof and of the adjacent door gasket. The assembly is completed by connecting a separate rear inner wall to the previously-formed top, side and bottom walls and connecting a separate rear outer wall to the previously-formed top, side and bottom outer walls. Finally, this cabinet assembly is placed in a suitable fixture which holds the walls in position and in the desired shape while foam insulation is injected into the space between the inner and outer walls to provide the necessary thermal insulation and to give final rigidity to the cabinet. In a modified form of the invention the single sheet of metal is stamped to provide also portions forming the back outer wall and the back inner wall of the refrigerator.

DESCRIPTION OF THE DRAWINGS

The invention may be better understood by reference to the following drawings, in which:

FIG. 1 is an isometric view of a refrigerator cabinet incorporating the construction of this invention.

FIG. 5 is an enlarged exploded view of one corner of the refrigerator cabinet, illustrating the manner of mounting condenser tubing in the assembled cabinet.

DESCRIPTION OF THE PREFERRED EMBODIMENT

Figure 2:
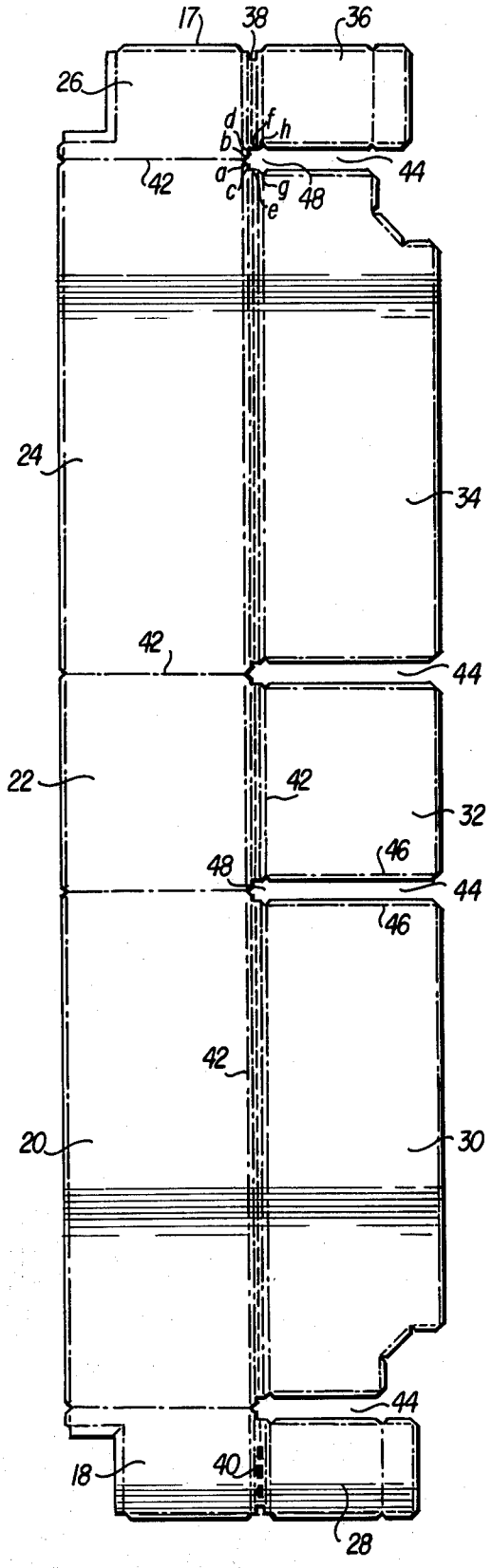
FIG. 2 is a developed view showing the single sheet of metal from which the inner and outer walls of the refrigerator cabinet are formed.

Referring now to the drawings, there is shown in FIG. 1, a refrigerator cabinet 10 incorporating this invention and constructed in accordance with the method of this invention. The cabinet includes an outer wall 12 and an inner wall 14 which forms the refrigerated food compartment 16 of the refrigerator. Suitable thermal insulation is incorporated in the space between the inner andd outer walls. It will be understood that the opening to the refrigerated compartment 16 will be closed by a suitable door. This door has been omitted since it is not essential to a description of the present invention.

The top, side and bottom outer walls and the top, side and bottom inner walls of the refrigerator cabinet are formed from a single piece 17 of sheet metal in accordance with the method of this invention. This may be better understood by reference to FIG. 2 which is a developed view of the single sheet of metal from which the aforementioned components of the refrigerator cabinet are formed. As shown in FIG. 2, the sheet is stamped to include, along the length of one side thereof, first portions identified by the numerals 18, 20, 22, 24, and 26. In the assembled form, the portions 20 and 24 form the side outer walls of the refrigerator cabinet, portion 22 forms the top outer wall and portions 18 and 26 together form the bottom of the outer wall. Along the length of this sheet at the other side thereof, second portions 28, 30, 32, 34 and 36, similar to portions 18, 20, 22, 24 and 26, respectively, are formed. As in the case of the outer wall, portions 30 and 34 form the side inner walls of the cabinent, portion 32 forms the top inner wall and portions 28 and 36 together form the bottom inner wall.

Figure 6:
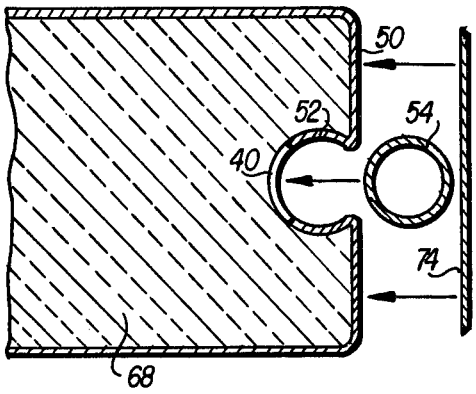
FIG. 6 is an exploded view, partly in section, further illustrating the relationship of the condenser tubing and the cabinet.
Figure 4:
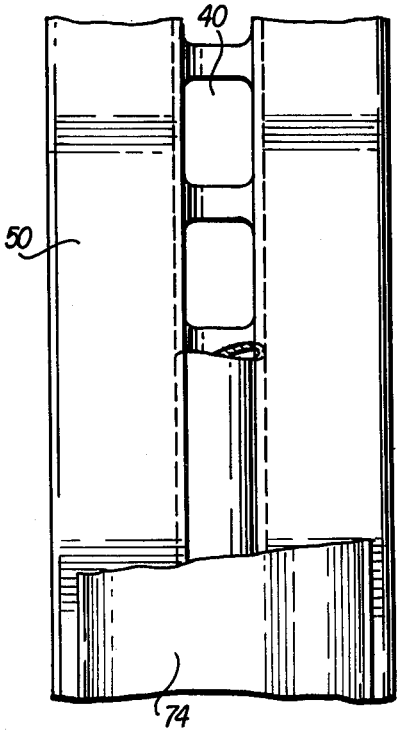
FIG. 4 is an enlarged elevation view of a portion of the front of the cabinet in the area framing the door opening.

Between the first portions and the second portions there are also formed in the single sheet 17 of sheet metal, in a section thereof designated 38, a plurality of elongated perforations, or thermal breaks, some of which are shown at 40 in FIG. 2 and in somewhat enlarged and clearer form in FIGS. 4, 5 and 6. While only three such perforations 40 have been illustrated in FIG. 2, it wll be understood that such perforations are formed throughout the length of the section 38. The perforations 40 are provided in the section 38 for the purpose of retarding heat flow from the outer wall of the refrigerator to the inner wall in a manner described more fully later in this specification. If desired, there may be formed in this same operation a plurality of score lines, designated by the numerals 42, to facilitate bending of the single sheet of metal to form the aforementioned outer and inner walls of the refrigerator cabinet.

As shown in FIG. 2 the first portions are formed in a continuous sheet oi metal interrupted by the score lines 42, if employed. On the other hand the second portions are formed to include a plurality of gaps 44, one such gap being disposed between each pair of adjacent portions 28, 30, 32, 34 and 36. These gaps are provided so that when the sheet 17 is bent to form the refrigerator cabinet the portions 30 and 32, for example, which in the assembled form constitute one side wall and the top wall of the inner liner of the refrigerator, overlap by only a narrow edge, indicated at 46 in FIG. 2. These narrow overlapping edges may then be welded or otherwise secured in position to complete the inner liner at one top corner thereof. The remaining gaps 44 provide for similar slight overlapping of adjacent portions at the other corners of the inner liner so that these portions may be similarly welded or otherwise secured at the remaining corners.

Figure 3:
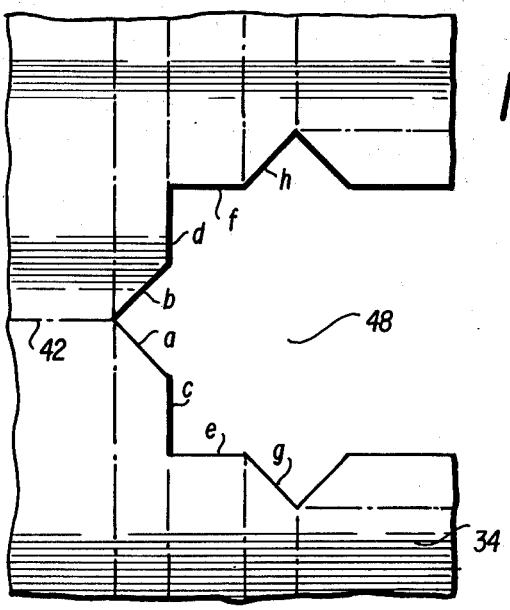
FIG. 3 is an enlarged view of a portion of FIG. 2 to show portions thereof in greater detail.

Each gap 44, where it intersects the section 38, is notched, as indicated at 48, to faciliate the forming of the corners of the face 50 which is formed by the second 38 and frames the door opening when the sheet 17 has been bent into assembled form. A comparison of the notch 48 shown in FIG. 3 and the assembled lower right corner of the cabinet formed from this portion of the sheet 17 and shown in FIG. 5 will illustrate the reason for the particular shape of the notch formed at the end of each gap 44. The letters *a, b, c, d, e, f, g* and *h* designate corresponding parts in stamped form in FIG. 3 and in assembled form in FIG. 5 and the relationship of these parts in the sheet form of FIG. 3 and as assembled in FIG. 5 can be readily appreciated. The remaining notches 48 similarly provide for a corresponding assembled relationship at the other corners of the surface 50 framing the door opening.

In the same or in a subsequent operation the section 38 is formed to provide an arcuate recess, as best shown at 52 in FIG. 5 which extends the length of the section 38. In the assembled form, as shown in FIG. 1, this ecess 52 extends completely around the face 50 which ames the door opening. The recess 52 is provided for eceiving a section of condenser tubing 54, the purpose f which will be discussed in more detail after the decription of the forming and assembly of the refrigerator abinet is completed.

After the sheet 17 has been stamped and formed in the nanner described above, it is placed in a suitable mahine for effecting the bending operation. There the heet is bent along the aforementioned score lines 42 to rovide the top, side and bottom outer walls and the op, side and bottom inner walls and the section forming he front face 50 against which the door of the refrigeraor (not shown) is intended to seal. After this bending peration is completed the corners of the inner liner are ecured in abutting relation with each other at the overapping portions 46 in any suitable manner. This may be ccomplished in any of a number of ways, for example, y adhesively bonding, crimping, stitching or stapling, r welding. Alternatively, these portions of the liner nay simply be held in proper relationship by the foam nsulation which later fills the space between the inner nd outer walls. The abutting portions 28 and 36 formng the bottom inner wall may be similarly secured in roper relationship and may be covered by a suitable lecorative strip if desired. Similarly, the portions 18 and 6 whcih form the bottom outer wall may be secured ogether in any suitable manner or merely left in abuting relationship. A separate back inner wall 56, formed s shown, is then secured to the previously-formed top, ide and bottom inner walls. Corresponding, a separate ack outer wall 58 is secured in assembled relationship vith the top, side and bottom outer walls of the previusly-formed portion of the cabinet. The back inner vall and back outer wall are shaped as shown at 60 and 52, respectively, to provide a machinery compartment 54 at the back lower portion of the cabinet for receiving he hermetically sealed compressor, indicated generally t 66, employed as part of the usual refrigerating system of a household refrigerator.

After the cabinet has been formed in the manner described, it is placed in a suitable foaming mold or fixture which provides support for both the inner walls and the outer walls of the cabinet and foam insulation is then injected into the space between the inner and outer walls. This can easily be accomplished in a conventional manner by providing, in the back outer wall of the cabinet, one or more openings for admitting the foam insulation to fill the space between the inner and outer walls and for permitting egress of air from this space. The insulation, is completed form is indicated at 68 in FIG. 1. The cabinet must be held in a suitable foaming mold or fixture which engages the outer and inner walls during the foaming process to prevent deformation of the walls but after the foamed insulation has set it provides strong support for the walls and rigidity to the cabinet.

After the cabinet has been formed in the manner just described, the condenser tubing 54 is assembled in the arcuate recess 52. The tubing 54 is simply a section of the condenser tubing normally employed in a refrigerating system to dissipate heat developed during the compressing and liquefaction of the refrigerant as part of the normal refrigerating operation. The remainder of the condenser tubing is positioned, as in a conventional refrigerator, in the machinery compartment 64. The section of the condenser tubing designated at 54 is formed in a loop framing the door opening (as best illustrated in the partially exploded view in FIG. 1) and aligned with the arcuate recess 52 which, as previously described, also frames the door opening. The ends of the loop, designated by the numerals 70, extend through one or more of the perforations 49 at the middle of the face 50 framing the door opening.

In the form of the invention shown, the outer diameter of the condenser tubing 54, as best shown in FIG. 6, is slightly greater than the width of the access opening 72 at the forward portion of the arcuate recess 52. Thus, after the condenser tubing 54 has been formed in a loop of the desired size and shape, it is pressed against the front face 50 in line with the opening 72 of the arcuate recess and pressure is exerted thereon, to cause the edges of the arcuate recess to be temporarily displaced and the tubing to snap into place within the recess 52. The tubing 54 may be forced into the recess 52 in any suitable manner; for example, a rubber mallet may be employed. In order to insure good thermal contact between the tubing 54 and the wall of the recess 52 a thermal mastic may be placed along the recess 52 on the outer wall side of the perforations 40 to provide good thermal contact between the condenser tubing and the wall of the recess. One suitable thermal mastic is that sold by Presstite Products, Inc. under the designation 440.22.

It can be seen by reference to FIG. 6 that when so assembled the tubing 54 conceals the perforations 40, eliminating any need for filling these perforations with vitreous enamel or other material to present a pleasing appearance. If desired, a decorative strip, such as that shown at 74 in FIG. 6, may be assembled on the front face 50 to cover the condenser tubing to provide an even more pleasing appearance. The strip 74 may be secured to the front face 50 in any suitable manner. Alternatively, if desired, a gasket, normally employed on the refrigerator door, may be mounted on the front face 50, thereby serving both to cover the recess 52 and condenser tubing 54 and to provide a surface against which the door in its closed position may seal.

The condenser tubing 54, in addition to covering and concealing the perforations 40, provides an even more significant function in supplying heat at a critical area of the cabinet so as to raise the temperature of the outer wall and thereby to minimize "sweating" of the outer wall in the area adjacent the front face 50. It will be understood that a substantial temperature differential must be maintained, particularly in summer, between the outer wall of the refrigerator and the food storage compartment formed by the inner wall of the refrigerator. As previously described, the perforations 40 are provided to substantially retard heat transmission from the outer wall to the inner wall under the temperature differential existing and thereby reduce the tendency for moisture from the air to condense on the outer wall in the area adjacent the front face 50. The use of the condenser tubing in the area of the front face, as described above, further increases the temperature of the outer wall by adding heat in the area of the recess 52 and thereby further reduces any tendency for moisture to condense on the outer wall. For example, if we assume that the temperature at the recess 52 is 50° F. without the condenser tubing, the heat introduced by the condenser tubing could raise this temperature to 60° F.

Figure 7:
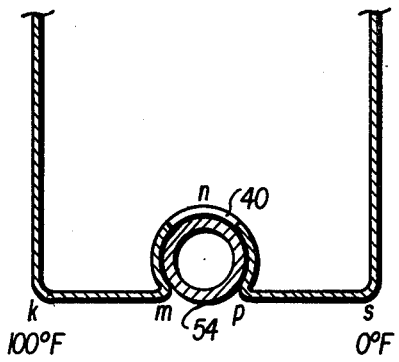
FIG. 7 represents schematically a section through a portion of the front face of the cabinet to illustrate thermal relationships.

The total effect of the introduction of heat from the condenser tubing at the arcuate recess may be further understood by using an electrical analogy and by reference to FIGS. 7, 8, 9 and 10. FIG. 7 illustrates schematically a section through a portion of a front face of the cabinet. For purposes of this discussion it is assumed that the ambient temperature is 100° F. and that the temperature inside the refrigerated compartment is 0° F. Relevant portions of the cabinet structure have been designated by the letters *k, m, n, p* and *s* in FIG. 7. The ambient temperature at *k* is 100° F. under the assumption given above and the temperature at *s* is 0° F. The temperature drops from *k* to *m* and from *p* to *s* may be considered negligible and may be ignored for purposes of our present discussion. In actuality there will, of course, be some temperature drop in these areas and further if the ambient temperature is 100° F. the temperature of the cabinet at *k* may be say 85° F. because of the temperature drop across a layer of air adjacent the wall of the cabinet. However, to simplify the presentation of the aforementioned analogy these temperature drops are being ignored. The thermal resistance, and hence the temperature drop, between *m* and *p* is high because of the perforations, or thermal beak openings, 40 introduced into the cabinet structure at this point, as previously described.

Figure 8:
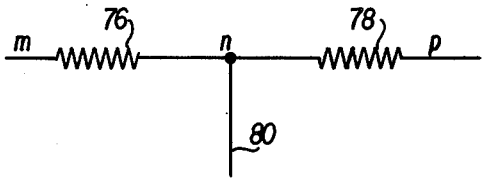
FIG. 8 illustrates an electrical analogy to the thermal relationships illustrated in FIG. 7.

By the electrical analogy, illustrated in FIG. 8, the thermal resistance from *m* to *p* may be regarded as the equivalent of two electrical resistances 76 and 78, the resistance 76 corresponding to the thermal resistance between *m* and *n* in FIG. 7 and the resistance 78 corresponding to the thermal resistance between *n* and *p* in FIG. 7. By the condenser tubing arrangement of this invention, heat is introduced at the point *n* and this is equivalent, electrically, to introducing current through a line 80 at the point *n* shown in FIG. 8.

Fourier's equation for steady flow of heat and Ohm's law are exactly analogous. Thus, $$Q = kA\frac{\Delta t}{L}$$

is analogous to $I = E/R$ where $Q$ (heat flow in BTU/-hour) is analogous to $I$ (amperes) $\Delta t$ (temperature difference in ° F.) is analogous to E (volts) $L/kA$ (thermal resistance) is analogous to R (ohms) where $L$ = length in inches, $k$ = thermal conductivity in BTU/hr/°F/ft²/in.

$A$ = area in ft²

Figure 9:
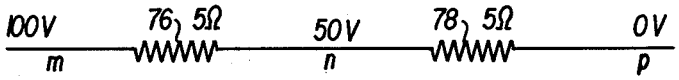
FIG. 9 illustrates an electrical analogy where no heat is supplied by condenser tubing.

Proceeding with the analogy, assume $\Delta t$ = 100° F. or 100 volts and assume that $$\frac{L}{kA} = \frac{5}{\text{BTU/hr/° F}}$$

or 5 ohms, and further assume, in accordance with earlier discussion, that the heat from the loop of condenser tubing raises the temperature at *n* by 10° F. or, by electrical analogy, the equivalent of 10 volts.

Where no heat is supplied from condenser tubing the electrical analogy may be represented as shown in FIG. 9. As there shown, with the assumed voltage and resistance, the current flowing from m to p would be given by the equation $$I = \frac{E}{R} = \frac{100}{5+5} = 10 \text{ amperes}$$

By analogy, assume this to correspond to 10 BTU/hr. That is, without the condenser tubing, the heat flow from the outer wall to the inner wall of the cabinet would amount to 10 BTU/hr.

Figure 10:
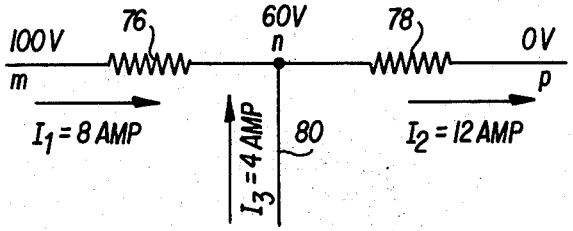
FIG. 10 illustrates an electrical analogy where heat is supplied by condenser tubing.

Now let us assume that the condenser tubing is placed in the arcuate recess and heat is therefore supplied at the point *n*. This will, of course, raise the temperature at the point *n* from 50° to 60° F., as discussed earlier. By electrical analogy, this is equivalent to supplying a current through the line 80 in FIG. 8. The result, in electrical terms, is represented in FIG. 10. The increase in temperature at point *n* through the use of the condenser tubing is represented in FIG. 10, by electrical analogy, by the increase in voltage from 50 volts shown in FIG. 9 to 60 volts shown in FIG. 10. Since the ambient temperature and the temperature within the refrigerator compartment are assumed to be the same as before, by electrical analogy the voltage at point *m* is still 100 volts and that at point *p* is still 0 volt.

The current flow (analogous to thermal flow) may be calculated as follows. The current $I_1$, flowing from *m* to *n* is calculated as:

$$I_1 = \frac{E}{R} = \frac{40}{5} = 8 \text{ amperes}$$

or, by analogy, 8 BTU/hr. The current flowing from point *n* to point *p* in this electrical analogy may be calculated as:

$$I_2 = \frac{E}{R} = \frac{60}{5} = 12 \text{ amperes}$$

or, by analogy, 12 BTU/hr. The current introduced at n is therefore $I_2 - I_1 = 12 - 8 = 4$ amperes or, by analogy, 4 BTU/hr.

By this electrical analogy it can be readily appreciated that heat introduced by the condenser tubing has increased the flow of heat from that point to the interior of the cabinet from 10 to 12 BTU/hr. At the same time, it not only has accomplished a reduction in the heat flow from the exterior of the cabinet from 10 to 8 BTU/hr but is has also increased the temperature at *n* from 50° to 60° F., and hence, has correspondingly reduced the tendency for moisture to deposit on the exterior of the cabinet, that is, has more effectively eliminated "sweating". Moreover, the electrical analogy illustrates that even though the heat leakage into the food compartment of the refrigerator is 10 BTU/hr without the condenser tubing and even though 4 BTU/hr is added by the condenser tubing the leakage into the food compartment is not increased to 14 BTU/hr but only to 12 BTU/hr because of the reduction of heat leakage from the exterior of the cabinet to the food compartment.

Further, despite the increase in heat flow to the interior of the cabinet from 10 to 12 BTU/hr in this example the overall efficiency of the refrigerator is not impaired, because the additional condenser tubing 54 adds to the total condenser surface and thus improves system efficiency in this respect. Thus, while the condenser tubing 54 adds some heat to the interior of the cabinet, that is, it adds 2 BTU/hr to the heat load seen by the evaporator employed to cool the interior of the refrigerator cabinet, it provides a compensating effect by increasing the condenser surface and improving system efficiency in this respect.

Figure 11:
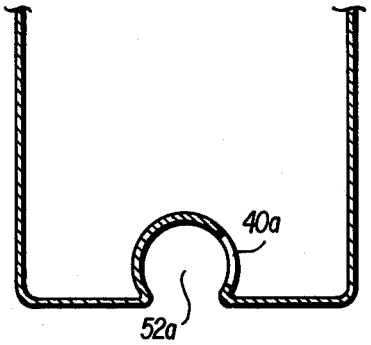
FIG. 11 is a view similar to FIG. 7 showing a modified embodiment of the invention.

A modified form of this invention is shown in FIG. 11, wherein thermal break perforations 40*a* in an arcuate recess 52*a* are provided at a position closer to the inner wall of the refrigerator rather than in a central portion of the recess as in the case of the perforations 40 in the embodiment described above. By positioning the perforations 40*a* closer to the inner wall than to the outer wall, the amount of heat supplied to the outer wall is increased thereby further reducing the tendency to sweat. Correspondingly, the amount of heat supplied to the inner wall is reduced.

Figure 12:
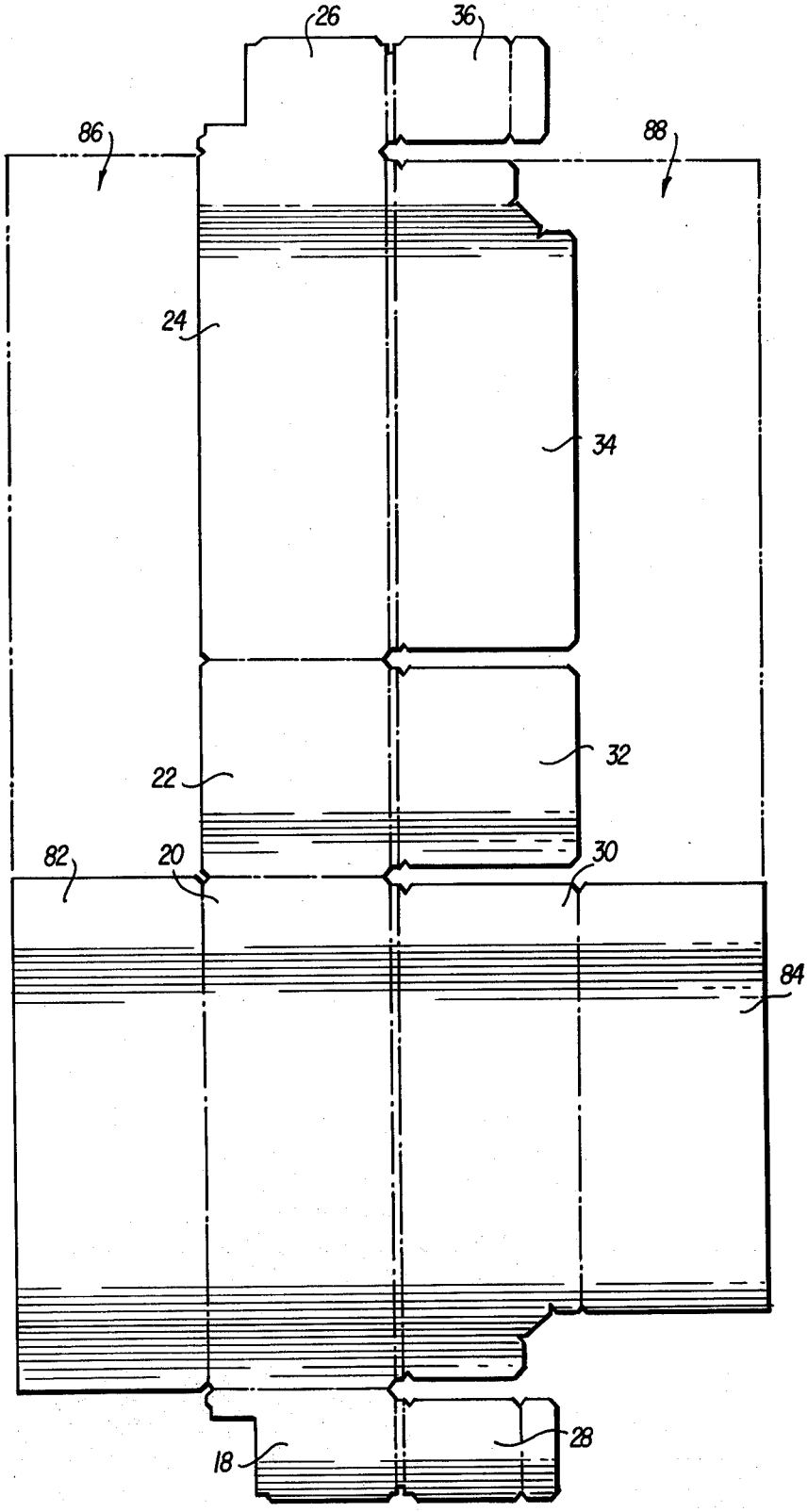
FIG. 12 is a developed view similar to FIG. 2 showing a modified form of the single sheet of metal for forming the inner and outer walls of the refrigerator cabinet.

In the embodiment of the invention shown in FIGS. 1–6 the back inner and back outer walls are formed separately and later assembled to the remainder of the cabinet which is formed from the single sheet of metal shown in FIG. 2. However, it is not necessary that the back inner and outer walls be separately formed. They may also be formed from the single sheet of metal as shown in the modification illustrated in FIG. 12. As there shown, the first portions 18, 20, 22, 24 and 26 and the second portions 28, 30, 32, 34 and 36 are formed exactly as in FIG. 2. However, in the modification shown in FIG. 12, the sheet also includes a portion 82 employed to form the back outer wall and a portion 84 employed to form the back inner wall. The portion 82 extends from the portion 20 which forms one of the outer side walls, and the portion 84 extends from the portion 30 which forms the corresponding inner side wall. The modification shown in FIG. 12 has the disadvantage that there is potentially a significant amount of wasted metal, for example, that indicated by the portions 86 and 88. This potential waste can be reduced by nesting the blanks stamped from the sheet metal but this, of course, requires the use of a wider strip of metal from which the blanks are stamped.

While the descriptions hereinabove are of various specific embodiments wherein a plurality of inner and outer refrigerator cabinet walls are formed from a single sheet of metal, it will be appreciated that the invention in its broader aspects contemplates a refrigerator cabinet construction characterized in that the cross section of any given cabinet wall comprises a continuous sheet of metal forming the inner and outer walls and a thermal break section therebetween, with a means for supplying heat associated with the thermal break section. Through the employment of this wall section construction, any number of the refrigerator cabinet walls may advantageously be formed from a single sheet of metal. In particular constructional configurations, a number of sheets of metal may be required, with suitable joints between the wall sections. However, in the preferred embodiments which were described in greater detail above, the wall section construction is utilized to form four cabinet walls, namely the top, bottom and both sides, from a single sheet of metal.

It can be seen from the above description that by utilizing this invention a refrigerator cabinet may be constructed more simply and more economically from a single sheet of metal which can be bent to form the top, side and bottom outer walls and the top, side and bottom inner walls of the refrigerator, and, if desired, also the back outer wall and back inner wall. Moreover, the construction includes provision for forming in the same initial operation, perforations which provide a thermal break between the outer walls and inner walls. Further, the invention discloses an arrangement utilizing a portion of the condenser tubing to conceal these perforations and to introduce heat at the thermal break to raise the temperature of the outer wall and further reduce any tendency for moisture to condense on the exterior of the cabinet.

While particular embodiments of this invention have been shown and described, it will be understood that other modifications falling within the spirit and scope of this invention may occur to those skilled in the art, and it is intended by the appended claims to cover all such modifications as fall within the spirit and scope of this invention.

What is claimed is:

1. A refrigerator cabinet comprising:

a single sheet of metal including a first portion for forming at least a portion of the outer wall of the cabinet, a second portion for forming at least a portion of the inner wall of the cabinet, and a section disposed between said first and second portions and having a plurality of perforations therein for retarding heat transfer between said first and second portions;

said sheet being bent to cause said first and second portions to form the portions of the inner and outer walls and said section to form at least a portion of a surface framing the door opening of the cabinet; and means disposed in assembled relation with said section for supplying heat thereto to reduce sweating of the outer wall of the cabinet.

2. The refrigerator cabinet of claim 1, wherein said means also conceals said perforations.

3. A refrigerator cabinet comprising:

a single sheet of metal including a plurality of first portions for forming the top, side and bottom outer walls of the cabinet;

said sheet further including a plurality of second portions for forming the top, side and bottom inner walls of the cabinet, said inner walls forming a food compartment;

said sheet further including a section disposed between said first portions and said second portions and having a plurality of perforations therein for retarding heat transfer between said first portions and said second portions;

said sheet being bent to cause said first portions and said second portions to form said top, side and bottom outer and inner walls and said section to form a surface framing the door opening of the cabinet; and means disposed in assembled relation with said section for supplying heat thereto to reduce sweating of the outer wall of the cabinet.

4. The refrigerator cabinet of claim 3, wherein:

said single sheet of metal further includes a third portion for forming the back outer wall of the cabinet and a fourth portion for forming the back inner wall of the cabinet; and said sheet is bent to cause said third portion to form the back outer wall of the cabinet and to cause said fourth portion to form the back inner wall of the cabinet.

5. The refrigerator cabinet of claim 3, wherein said means also conceals said perforations.

6. The refrigerator cabinet of claim 3, and further comprising a refrigerating system including a condenser and wherein said means comprises a portion of said condenser.

7. The refrigerator cabinet of claim 6, wherein:

said section is formed to provide an arcuate recess therein;

said portion of said condenser comprises tubing; and said tubing is received in said arcuate recess and both supplies heat to raise the temperature of the outer wall and conceals said perforations.

8. The refrigerator cabinet of claim 7, wherein:

said arcuate recess includes said perforations.

9. The refrigerator cabinet of claim 7, wherein:

said arcuate recess has an access opening slightly smaller than the outer diameter of said tubing; and said tubing is forced into said recess through said access opening.

10. The refrigerator cabinet of claim 7, wherein:

said section includes openings therethrough near the center of the bottom wall; and said condenser tubing extends through said openings.

* * * * *